US005797494A

United States Patent [19]

Balling et al.

[11] Patent Number: 5,797,494

[45] Date of Patent: Aug. 25, 1998

[54] FOOD PACKET AND METHOD FOR FORMING A PACKET FOR A FOOD PRODUCT

[75] Inventors: T. Thomas Balling, Lagny sur Marne; Pascal C. Godard, Villemonble, both of France

[73] Assignee: Kraft Jacobs Suchard France, France

[21] Appl. No.: 621,148

[22] Filed: Mar. 21, 1996

Related U.S. Application Data

[63] Continuation of Ser. No. 203,069, Feb. 28, 1994, abandoned.

[51] Int. Cl.[6] ..... B65D 83/10

[52] U.S. Cl. ..... 206/460; 206/800

[58] Field of Search ..... 426/5; 229/87.07; 206/800, 460; 53/214

[56] References Cited

U.S. PATENT DOCUMENTS

| | | | |
|---|---|---|---|
| 1,132,781 | 3/1915 | Lile . | |
| 1,216,259 | 2/1917 | Armstrong | 426/5 |
| 1,329,056 | 1/1920 | Mester . | |
| 1,865,535 | 7/1932 | Meany | 229/87.07 |
| 2,118,849 | 5/1938 | Lindsey . | |
| 2,128,843 | 8/1938 | Mullins | 426/5 |
| 2,165,539 | 7/1939 | Dahlgren | 206/460 |
| 2,192,472 | 3/1940 | Huston | 426/5 |
| 2,192,473 | 3/1940 | Huston | 206/800 |
| 2,208,229 | 7/1940 | Ranney | 426/5 |
| 2,210,194 | 8/1940 | Baldwin | 426/5 |
| 2,210,195 | 8/1940 | Baldwin | 426/5 |
| 2,210,196 | 8/1940 | Baldwin | 426/5 |
| 2,380,367 | 7/1945 | Ranney | 426/5 |
| 2,992,117 | 7/1961 | Rosen et al. | 426/128 |
| 3,000,744 | 9/1961 | Lingelbach | 426/128 |
| 3,201,258 | 8/1965 | Mastella | 426/5 |
| 3,323,643 | 6/1967 | Rush | 206/460 |
| 3,374,884 | 3/1968 | Chinkes | 206/460 |

FOREIGN PATENT DOCUMENTS

| | | | |
|---|---|---|---|
| 2030699 | 11/1970 | France | B65D 5/06 |
| 2675774 | 10/1992 | France | 206/460 |
| WO95/13228 | 5/1995 | WIPO | B65D 75/52 |

*Primary Examiner*—David T. Fidei

*Attorney, Agent, or Firm*—Thomas A. Marcoux; Thomas R. Savoie

[57] ABSTRACT

A food packet and preferably a chewing gum packet for holding the chewing gum sticks in the packet after the initial opening and a method for forming the packets.

16 Claims, 2 Drawing Sheets

FOOD PACKET AND METHOD FOR FORMING A PACKET FOR A FOOD PRODUCT

This application is a continuation, of application Ser. No. 08/203,069, filed Feb. 28, 1994 now abandoned.

BACKGROUND OF THE INVENTION

The present invention relates to cartons or packets of food products and to methods for making such cartons or packets. More specifically, this invention relates to such cartons or packets that are well suited for holding sticks of chewing gum.

Chewing gum is commonly sold in small packets, in which a number of sticks of chewing gum are wrapped and enclosed in a packing or wrapping material. Typically, the packet is opened by removing or opening a top portion or cover of the packet. For instance, the packet may be opened by pulling a narrow tear strip that extends around a top portion of the packet to separate that top portion from the rest of the packet. That top portion is then removed, providing access to the individual chewing gum sticks in the packet. A disadvantage of this conventional prior art procedure is that after the top portion of the packet is removed, the chewing gum sticks may slide out of the packet and scatter in, for instance, the pocket or purse of the person carrying the packet.

Prior art chewing gum packets are disclosed, for example, in U.S. Pat. Nos. 2,118,849, 1,329,056, and 1,132,781. U.S. Pat. Nos. 2,118,849 and 1,329,056 disclose chewing gum packets having top covers that are separated from the bodies of the packets either by removing a tear strip or by tearing along a perforated line. U.S. Pat. No. 1,132,781 discloses a chewing gum packet having a top flap that can be selectively opened and closed. This top flap is formed by a separate strip of material that is prefolded and then inserted into the gum package.

SUMMARY OF THE INVENTION

The present invention relates to a food packet and to a method for forming a food packet. The food packet includes a wrapping material, food products, and an adhesive. The wrapping material forms an interior, and the food products are disposed in that interior. The adhesive is applied on the wrapping material and engages the food products to hold those products releasably in the interior of the wrapping material after that material is opened. Preferably, the wrapping material includes a removable portion to provide access to the interior of the wrapping material, and a tear strip is provided to help remove that removable portion.

The packet of this invention may be used with a variety of food products. In a preferred embodiment, for instance, the food products are sticks of chewing gum.

Preferably, the adhesive is applied on an inside surface of a bottom panel formed by the wrapping material, and for example, the adhesive may be applied along areas of that inside surface that are adjacent the left and right edges of that bottom panel. Also, preferably, the adhesive is a heat reactivatably adhesive, and is reactivated when the wrapping material is wrapped around the food products.

To form the food product, a supply of the wrapping material is provided, and the adhesive is applied to a first side of that wrapping material. A plurality of the food products are positioned on that first side of the wrapping material. A plurality of the food products are positioned on that first side of the wrapping material; and the wrapping material is folded about the food products to form a packet enclosing the food products, and with the adhesive engaging those food products to hold those products releasably in the packet.

As mentioned above, the adhesive is preferably a heat reactivatable adhesive, and the adhesive is reactivated when the wrapping material is wrapped around the food products. In particular, with the preferred wrapping procedure, various edges or edge portions of the wrapping material are overlapped and then heat sealed together to form panels of the packet, and preferably the adhesive is reactivated by the heat that is applied to connect together those overlapping portions of the wrapping material.

Further benefits and advantages of the invention will become apparent from a consideration of the following detailed description given with reference to the accompanying drawings, which specify and show preferred embodiments invention.

DETAILED DESCRIPTION OF THE PREFERRED EMBODIMENTS

Figure 1:
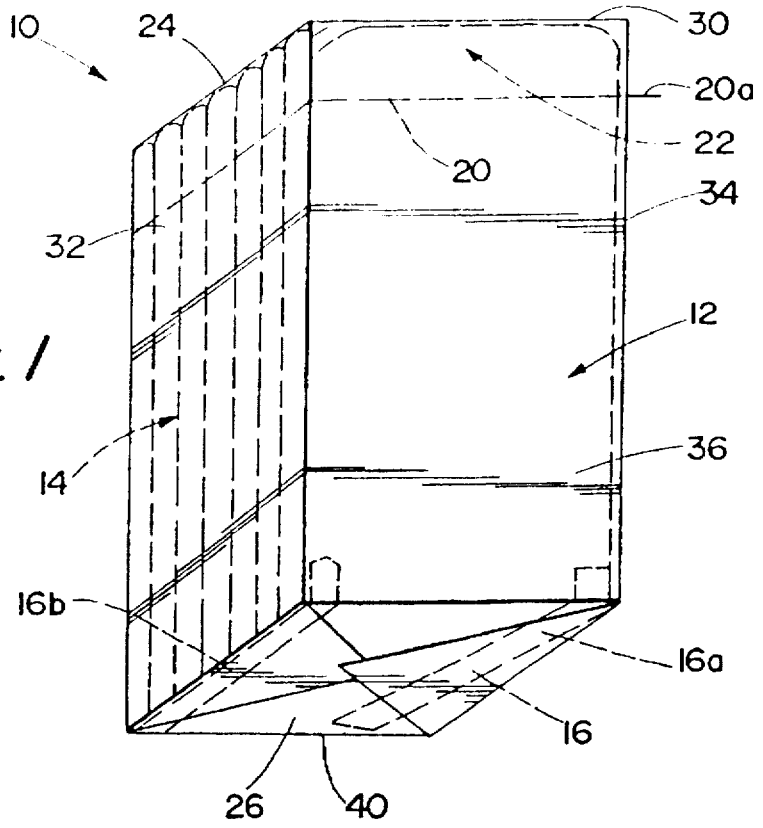
FIG. 1 is a bottom perspective view of a packet embodying the present invention.

FIG. 1 illustrates packet 10 comprising wrapping material 12, food products 14, and adhesive 16, and preferably the packet further comprises tear strip 20. Generally, wrapping material 12 forms an interior 22, and food products 14 are disposed in the interior of the wrapping material. Adhesive 16 is applied on wrapping material 12 and engages food products 14 to hold those products releasably in interior 22 of the wrapping material after the wrapping material is opened. Preferably, wrapping material 12 includes a movable cover or removable portion 24 to provide access to interior 22 of the wrapping material, and tear strip 20 is provided to help remove that removable portion 24.

Preferably, adhesive 16 is applied on an inside surface of a bottom panel 26 formed by wrapping material 12. For example, the adhesive may be applied along areas **16*a* and 16*b* of that inside surface that are adjacent the left and right edges of that bottom panel. Adhesive 16 may comprise any suitable adhesive, and preferably the adhesive is a reactivatable adhesive. Even more preferably, adhesive 16 is a heat reactivatable adhesive and is reactivated, in a manner discussed in detail below, when wrapping material 12 is wrapped around food products 14**.

In the preferred embodiment of packet 10 illustrate in FIG. 1, wrapping material 12 is formed into the shape of a hollow box or cube, and includes bottom and top panels 26 and 30, left and right side panels 32 and 34, and front and back panels 36 and 40. With this preferred embodiment, removable portion 24 is a top portion of the wrapping material.

The food products 14 of the packet 10 shown in FIG. 1 have flat, thin shapes, and these food products are substantially identical to each other. Inside packet 10, products 14 are arranged one behind another, between front and back panels 36 and 40 of wrapping material 12. In addition, each of the food products 14 extends upward from bottom panel 26 of packet 10, and laterally extends substantially completely across the packet, between left and right side panels 32 and 34. Further, each of the food products 14, specifically lower edges thereof, engages both of the adhesive areas 16*a* and 16*b* on bottom panel 26.

Packet 10 may be used with a variety of different types of food products. Preferably, however, food products 14 are sticks of chewing gum, and each stick includes a foil cover or wrapper.

As mentioned above, tear strip 20 may be provided to help remove removable portion 24. In particular, tear strip 20 is attached to the inside surface of wrapping material 12 and transversely extends around the inside perimeter of the wrapping material, adjacent and spaced from top panel 30. A small portion 20*a* of the tear strip 20 extends outside wrapping material 12, allowing a user to grip the tear strip.

Figure 2:
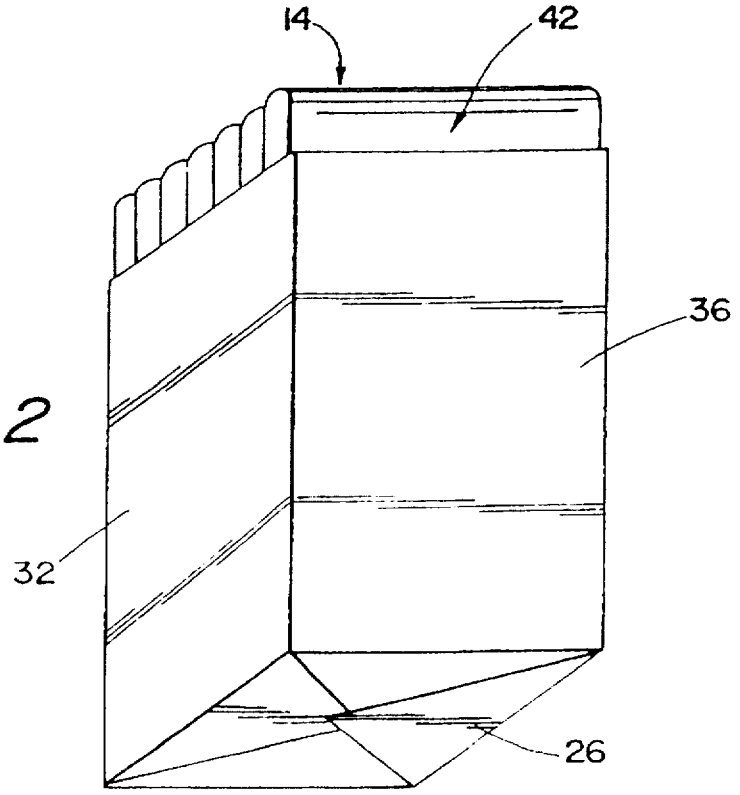
FIG. 2 is a bottom perspective view of the packet, with a top portion thereof removed.
Figure 3:
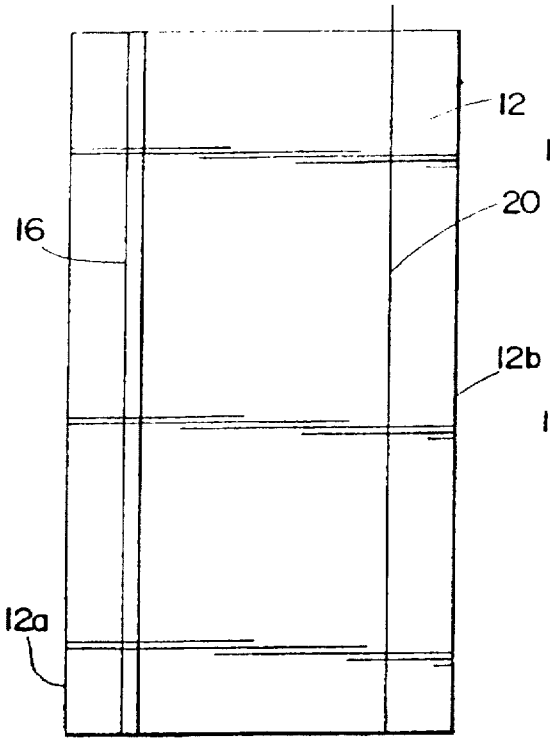
FIG. 3 is a plan view of a wrapping material that may be used in making a packet in accordance with this invention.
Figure 4:
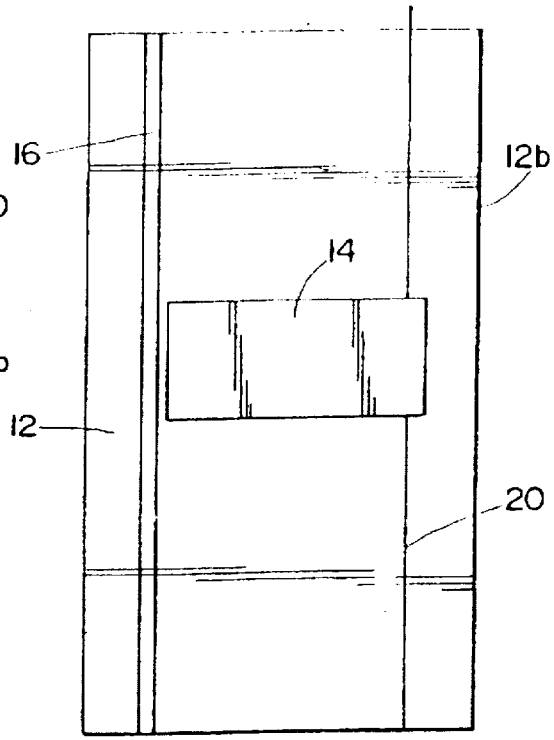
FIG. 4 shows a first stage of a procedure for forming the packet.
Figure 5:
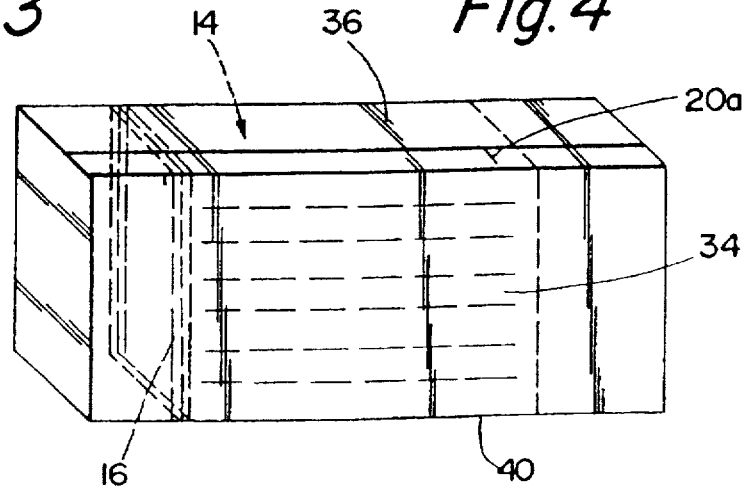
FIG. 5 illustrates an intermediate stage of the packet forming procedure.
Figure 6:
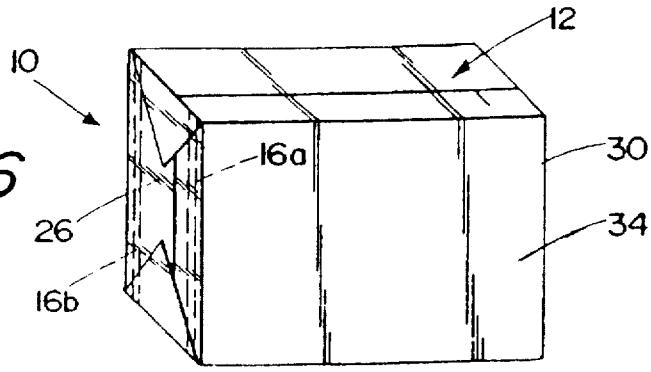
FIG. 6 shows a still later stage of the procedure for forming the packets.

With reference to FIGS. 1 and 2, in use, a consumer grips tear strip 20 and pulls it away from wrapping material 12, separating top portion 24 thereof from the rest of the wrapping material. That top portion 24 is then removed, forming top opening 42; and the consumer may remove food products from packet 10 by firmly pulling those products out of the packet, through top opening 42. Any food products not pulled out of packet 10 are firmly held therein by adhesive 16, helping to ensure that the food products do not slide or inadvertently fall out of the packet.

Wrapping material 12 and tear strip 20 may be made from any suitable materials. For example, wrapping material 12 may be made of a flexible packing material such as paper, and one face or side of the wrapping material may be plasticized. Alternatively, wrapping material 12 may be made of a thermal plastic film. Tear strip 20 may be glued to wrapping material 12 by a conventional process, and the tear strip is made of a material that is stronger than the wrapping material, so that as the tear strip is torn away from packet 10, the wrapping material tears away with the tear strip.

FIGS. 3–6 illustrate a procedure that may be used to form packet 10, and in particular, to wrap food products 14 in wrapping material 12. Generally, in accordance with this procedure, a supply of wrapping material 12 is provided, and adhesive 16 is applied to a first side of that wrapping material. A plurality of food products 16 are positioned on that first side of wrapping material 12; and wrapping material 12 is folded about food products 14 to form a packet enclosing the food products, with adhesive 16 engaging those food products to hold those products releasably in the packet. Preferably, the packet is provided with a removable portion to facilitate providing access to food products 14 in the packet.

Preferably, adhesive 16 is applied onto an area of wrapping material 12 that extends along and is slightly spaced from a first longitudinally extending edge 12*a* of the wrapping material. Also, wrapping material 12 is folded about food products 14 so that adhesive 16 is on the bottom panel of the formed packet, and in particular, so that the adhesive extends along the left and right edges of that bottom panel.

Furthermore, preferably adhesive 16 is a reactivatable adhesive, and in particular, a heat reactivatable adhesive; and the adhesive is reactivated when wrapping material 12 is wrapped around food products 14. To elaborate, with the preferred wrapping procedure, various edges or edge portions of wrapping material 12 are overlapped and then heat sealed together to form bottom and top panels 26 and 30 of packet 10, and preferably the adhesive is reactivated by the heat that is applied to connect together these overlapping portions of the wrapping material. Any suitable heating procedure may be employed to connect together these overlapping portions of wrapping material 12 and to reactivate adhesive 16.

In the above-described process for forming packet 10, preferably the packet is provided with the removable portion by adhering tear strip 20 to the first side of wrapping material 12, parallel to and adjacent a second longitudinally extending edge 12*b* of that wrapping material. As previously mentioned, tear strip 20 may be formed of any suitable material and may be attached to wrapping material 12 using a conventional adhesive.

Preferably, packets 10 are formed on a continuous automated basis; and in this procedure, wrapping material 12 is continuously supplied from a source thereof. For example, that source may be roll of wrapping material 12 that is continuously unwound. Adhesive 16 may be continuously applied to wrapping material 12 as that material is unwound from the supply roll. Alternatively, adhesive 16 may be applied to wrapping material 12 before it is wound onto the supply roll, in which case, the adhesive is on the wrapping material when that material is unwound from the supply roll. Similarly, tear strip 20 may be continuously applied to wrapping material 12 as it is unwound from the supply roll, or the tear strip may be applied to the wrapping material before it is wound onto that supply roll.

With this continuous process, wrapping material 12 is transversely cut at regular intervals to form sections of the wrapping material. Each of these sections is then wrapped around a respective group of food products 14, in the manner discussed above, to form a packet 10.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A food package comprising:

(a) an outer wrap including an inside surface having first and second opposite edges, and folded into an elongated regular hexahedron shaped packet forming an interior having longitudinal, transverse and depth dimensions, said longitudinal dimension being longer than both the transverse and depth dimensions, said packet including i) opposing and parallel top and bottom panels, said top and bottom panels being spaced apart and defining said longitudinal dimension, ii) opposing and parallel left and right side panels connected to and extending between the top and bottom panels, said left and right side panels being spaced apart and defining the transverse dimension, and iii) opposing and parallel front and back panels connected to and extending between the left and right side panels and connected to and extending between the top and bottom panels, said front and back panels being spaced apart and defining the depth dimension, wherein the top, bottom, left side, right side, front and back panels define and enclose the interior of the outer wrap;

(b) a plurality of food products disposed in the interior of the packet, each of the food products including i) opposing and parallel top and bottom edges, ii) opposing and parallel left and right edges connected to and longitudinally extending between the top and bottom edges, and iii) opposing and parallel front and back sides connected to and transversely extending the left and right edges and connected to and longitudinally extending between the top and bottom edges, wherein the food products are parallel to each other and are positioned one behind another, and wherein the front and back sides of the food products are parallel to the front and back panels of the outer wrap, the bottom edges of the food product are adjacent and parallel to the bottom panel, and the food products longitudinally extend upward from said bottom panel to a position adjacent the top panel of the outer wrap;

wherein the top panel of the outer wrap is removable to form a top opening, opposite the bottom panel, to provide access to the interior of the outer wrap and the food products located therein; and (c) a substantially continuous adhesive strip extending along substantially the complete length of the inside surface of the outer wrap, between said first and second edges thereof, and forming an adhesive strip section on the bottom panel, and wherein each of the food products transversely extends across the interior of the outer wrap, between the left and right side panels thereof, and the bottom edge of each of the food products laterally extends across and engages the adhesive strip section on the bottom panel to hold the food products releasably in the interior of the wrapping material after the top panel of the packet is removed.

2. A chewing gum package comprising:

(a) an outer wrap including an inside surface having first and second opposite edges, and folded into an elongated regular hexahedron shaped packet forming an interior having longitudinal, transverse and depth dimensions, said longitudinal dimension being longer than both the transverse and depth dimensions, said packet including i) opposing and parallel top and bottom panels, said top and bottom panels being spaced apart and defining said longitudinal dimension, ii) opposing and parallel left and right side panels connected to and extending between the top and bottom panels, said left and right side panels being spaced apart and defining the transverse dimension, and iii) opposing and parallel front and back panels connected to and extending between the left and right side panels and connected to and extending between the top and bottom panels, said front and back panels being spaced apart and defining the depth dimension, wherein the top, bottom, left side, right side, front and back panels define and enclose the interior of the outer wrap;

(b) a multitude of sticks of chewing gum disposed in the interior of the outer wrap, each of the chewing gum sticks including i) opposing and parallel top and bottom edges, ii) opposing and parallel left and right edges connected to and longitudinally extending between the top and bottom edges, and iii) opposing and parallel front and back sides connected to and transversely extending between the left and right edges and connected to and longitudinally extending between the top and bottom edges, wherein the chewing gum sticks are parallel to each other and are positioned one behind another; and wherein the front and back sides of the chewing gum sticks are parallel to the front and back panels of the outer wrap, the bottom edges of the chewing gum sticks are adjacent and parallel to the bottom panel, and the chewing gum sticks longitudinally extend upward from said bottom panel to a position adjacent the top panel;

wherein the top panel of the outer wrap is removable to form a top opening, opposite the bottom panel, to provide access to the interior of the outer wrap and the chewing gum sticks located therein; and (c) a substantially continuous adhesive strip extending along substantially the complete length of the inside surface of the outer wrap, between said first and second edges thereof, and forming an adhesive strip section on the bottom panel; and wherein each of the chewing gum sticks transversely extends across the interior of the outer wrap, between the left and right side panels thereof, and the bottom edge of each of the chewing gum sticks laterally extends across and engages the adhesive strip section on the bottom panel to hold the chewing gums sticks releasably in the interior of the outer wrap after the top panel of the packet is removed.

3. A method of forming a food package, comprising the steps of:

providing a supply of a wrapping material, said wrapping material including a first side having first and second opposite edges;

applying an adhesive to the first side of the wrapping material to form a substantially continuous adhesive strip along the complete length of the first side, between said first and second opposite edges;

positioning a plurality of food products on the first side of the wrapping material, said food products including opposing and parallel top and bottom edges, opposing and parallel left and right edges longitudinally extending between the top and bottom edges, and opposing and parallel front and back sides transversely extending between the left and right edges and longitudinally extending between the top and bottom edges;

folding the wrapping material about the food products to form a packet enclosing the food products, said folding step including the steps of i) folding the wrapping material into an elongated regular hexahedron shaped packet forming an interior having longitudinal, transverse and depth dimensions, with said longitudinal dimension being longer than the transverse and depth dimensions, said packet including (1) opposing and parallel top and bottom panels, said top and bottom panels being spaced apart and defining the longitudinal dimension, (2) opposing and parallel left and right side panels being spaced apart and defining the transverse dimension, and (3) opposing and parallel front and back panels, said front and back panels being spaced apart and defining the depth dimension, wherein the top, bottom, left side, right side, front and back panels define and enclose the interior of the packet and enclose the food products therein, and ii) forming the adhesive strip into an adhesive strip section on said bottom panel;

wherein the food products are parallel to each other and are positioned one behind another; and wherein the front and back sides of the food products are parallel to the front and back panels of the packet, the bottom edges of the food products are adjacent and parallel to the bottom panel, and the food products longitudinally extend upward from said bottom panel to a position adjacent the top panel;

wherein the top panel of the packet is removable to form a top opening, opposite the bottom panel, to provide access to the interior of the packet and the food products located therein; and wherein each of the food products transversely extends across the interior of the packet, between the left and right side panels thereof, and the bottom edges of each of the food products laterally extends across and engages the adhesive strip section on the bottom panel to hold the food products releasably in the interior of the wrapping material after the top panel of the packet is removed.

4. A food package according to claim 1, wherein:

the outer wrap includes third and fourth opposite and parallel edges; and the adhesive strip is parallel to and spaced from said third and fourth edges.

5. A chewing gum package according to claim 2, wherein:

the outer wrap includes third and fourth opposite and parallel edges; and the adhesive strip is parallel to and spaced from said third and fourth edges.

6. A method according to claim 3, wherein:

the wrapping material has third and fourth opposite and parallel edges; and the adhesive strip is parallel to and spaced from said third and fourth edges.

7. A food package according to claim 1, wherein: the bottom panel includes left and right edges; and the adhesive is applied on said bottom panel adjacent the left and right edges thereof.

8. A food package according to claim 1, wherein the adhesive is a reactivatable adhesive.

9. A food package according to claim 8, wherein the adhesive is a heat reactivatable adhesive.

10. A food package according to claim 9, wherein:

the wrapping material includes overlapping portions that are heat sealed together; and the adhesive is reactivated when said overlapping portions are heat sealed together.

11. A chewing gum package according to claim 2, wherein:

the bottom panel of the wrapping material includes left and right edges; and the adhesive is located on said bottom panel adjacent said left and right edges.

12. A chewing gum package according to claim 2, wherein:

the wrapping material includes overlapping portions that are heat sealed together; and the adhesive is a heat reactivated adhesive, and is reactivated when said overlapping portions are heat sealed together.

13. A method according to claim 3, wherein:

the applying step includes the step of applying a reactivatable adhesive to said first side of the wrapping material; and the step of folding the wrapping material into an elongated cube includes the steps of i) overlapping portions of the wrapping material, and ii) heating said overlapping portions to connect said overlapping portions together, wherein the reactivatable adhesive is reactivated during the heating step.

14. A method according to claim 13, wherein the overlapping step includes the step of overlapping portions of the wrapping material to form the bottom of the packet.

15. A method according to claim 14, wherein:

the wrapping material has first and second, opposite longitudinally extending edges; and the step of applying the reactivatable adhesive includes the step of applying the reactivatable adhesive onto the wrapping material parallel to and adjacent the first longitudinally extending edge thereof.

16. A method according to claim 15, wherein:

the step of providing the supply of wrapping material includes the steps of i) continuously providing wrapping material from the supply thereof, and ii) transversely cutting the wrapping material at regular intervals to form sections of the wrapping material; and the step of applying the reactivatable adhesive includes the step of continuously applying the reactivatable adhesive along the first longitudinally extending edge of the wrapping material.

* * * * *